US010961771B2

(12) United States Patent
Angelone

(10) Patent No.: US 10,961,771 B2
(45) Date of Patent: Mar. 30, 2021

(54) SLIDING DOOR MODULE INSERT ASSEMBLY

(71) Applicant: Joseph Angelone, Henderson, NV (US)

(72) Inventor: Joseph Angelone, Henderson, NV (US)

( * ) Notice: Subject to any disclaimer, the term of this patent is extended or adjusted under 35 U.S.C. 154(b) by 106 days.

(21) Appl. No.: 16/414,300

(22) Filed: May 16, 2019

(65) Prior Publication Data

US 2020/0362621 A1 Nov. 19, 2020

(51) Int. Cl.
*E06B 3/68* (2006.01)
*E06B 7/32* (2006.01)

(52) U.S. Cl.
CPC ..... *E06B 7/32* (2013.01)

(58) Field of Classification Search
CPC ..... E06B 7/32
USPC ..... 49/57; 52/204.51
See application file for complete search history.

(56) References Cited

U.S. PATENT DOCUMENTS 3,654,733 A * 4/1972 Blackwell ..... E06B 7/32 49/168
3,811,224 A * 5/1974 Garrison ..... E06B 7/32 49/168
5,185,954 A * 2/1993 Waddle, Sr. ..... E06B 7/32 49/168
5,551,188 A * 9/1996 Davlantes ..... E05B 13/005 292/132
5,946,855 A * 9/1999 Miconi ..... E06B 9/52 160/180
6,691,483 B2 * 2/2004 Lethers ..... E06B 7/32 49/169
7,024,820 B1 * 4/2006 Dustin ..... E06B 9/52 160/105
7,207,141 B2 * 4/2007 Sullivan ..... E06B 7/32 119/481
8,074,606 B1 * 12/2011 Schrey ..... E06B 7/32 119/484
9,388,631 B2 * 7/2016 Woeltjen, Jr. ..... E06B 5/11
2006/0201638 A1 * 9/2006 Hesketh ..... E06B 7/32 160/180
2010/0269413 A1 * 10/2010 Sullivan ..... E06B 7/32 49/171
2013/0047517 A1 * 2/2013 Peterson ..... E06B 7/32 49/463
2014/0259937 A1 * 9/2014 Louie ..... E05C 1/04 49/168
2016/0043795 A1 2/2016 Kroeger
2019/0316411 A1 * 10/2019 Vanek ..... A47G 29/22

FOREIGN PATENT DOCUMENTS

WO WO-2016043795 A1 * 3/2016 ..... E06B 7/28

* cited by examiner

*Primary Examiner* — Jerry E Redman

(57) ABSTRACT

A sliding door module insert assembly for selective egress of a pet and a user includes a panel and a pet door. The panel is sized so that the panel is configured to position in an orifice of a sliding door module. A slat, which is shaped substantially complementarily to a side of a frame of the sliding door module, is hingedly coupled to a first side edge of the panel. The slat is configured to insert into the frame so that the slat is frictionally coupled to the frame, positioning the panel to selectively swing relative to the frame to open and close the orifice to allow a user to enter and exit the dwelling. The pet door is coupled to the panel so that the pet door is positioned to selectively close an aperture that is positioned in the panel.

13 Claims, 5 Drawing Sheets

SLIDING DOOR MODULE INSERT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to insert assemblies and more particularly pertains to a new insert assembly for selective egress of a pet and a user.

BRIEF SUMMARY OF THE INVENTION

An embodiment of the disclosure meets the needs presented above by generally comprising a panel and a pet door. The panel is sized so that the panel is configured to position in an orifice of a sliding door module. A slat, which is shaped substantially complementarily to a side of a frame of the sliding door module, is hingedly coupled to a first side edge of the panel. The slat is configured to insert into the frame so that the slat is frictionally coupled to the frame, positioning the panel to selectively swing relative to the frame to open and close the orifice to allow a user to enter and exit the dwelling. The pet door is coupled to the panel so that the pet door is positioned to selectively close an aperture that is positioned in the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
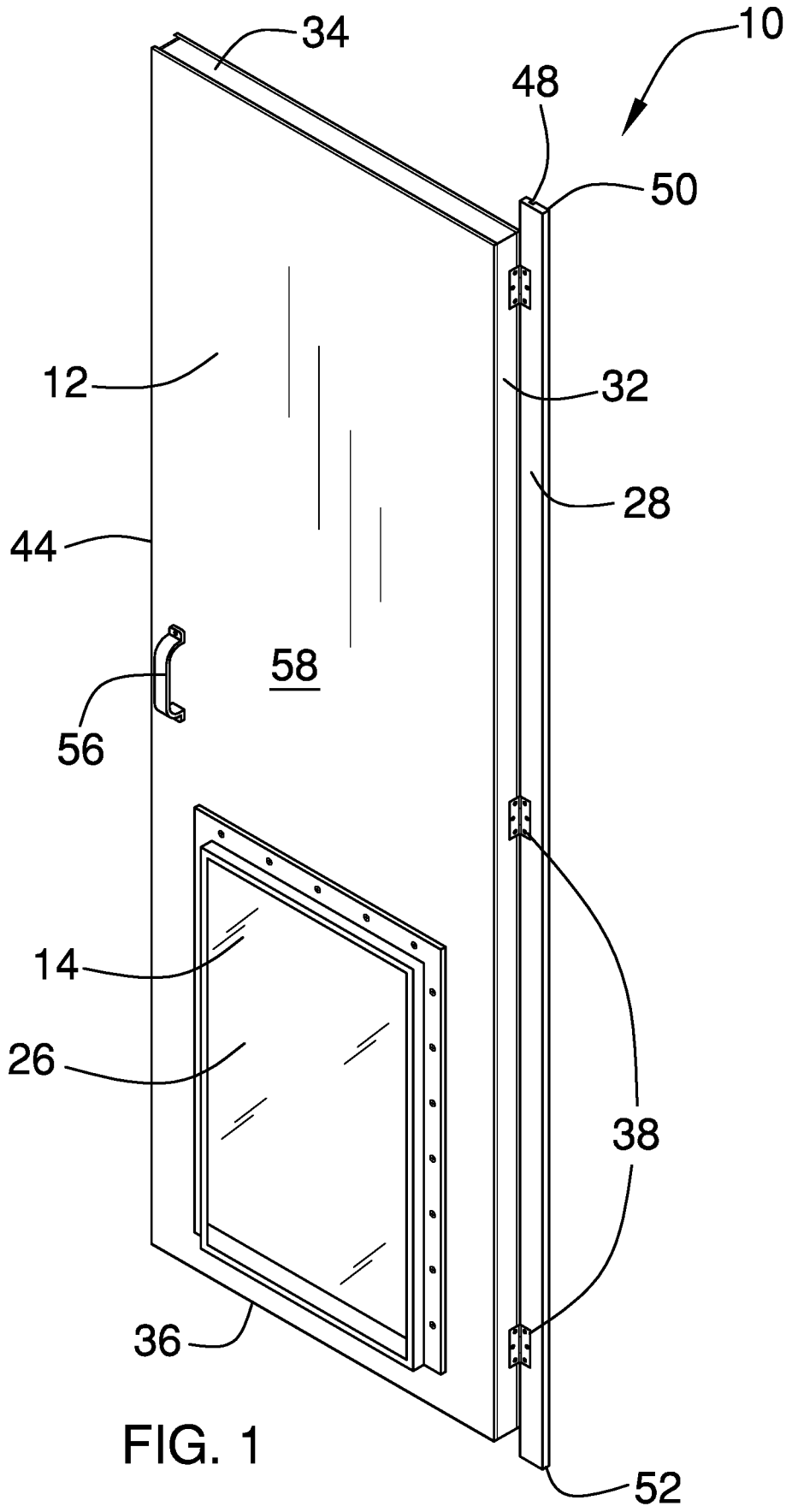
FIG. 1 is an isometric perspective view of a sliding door module insert assembly according to an embodiment of the disclosure.

With reference now to the drawings, and in particular to FIGS. 1 through 5 thereof, a new insert assembly embodying the principles and concepts of an embodiment of the disclosure and generally designated by the reference numeral 10 will be described.

As best illustrated in FIGS. 1 through 5, the sliding door module insert assembly 10 generally comprises a panel 12 and a pet door 14. The panel 12 is sized so that the panel 12 is configured to position in an orifice 16 of a sliding door module 18 that is positioned in an exterior wall of a dwelling. The panel 12 extends from proximate to a top 20 to proximate to a bottom 22 of a frame 24 of the sliding door module 18. An aperture 26, which is rectangularly shaped, is positioned in the panel 12.

Figure 2:
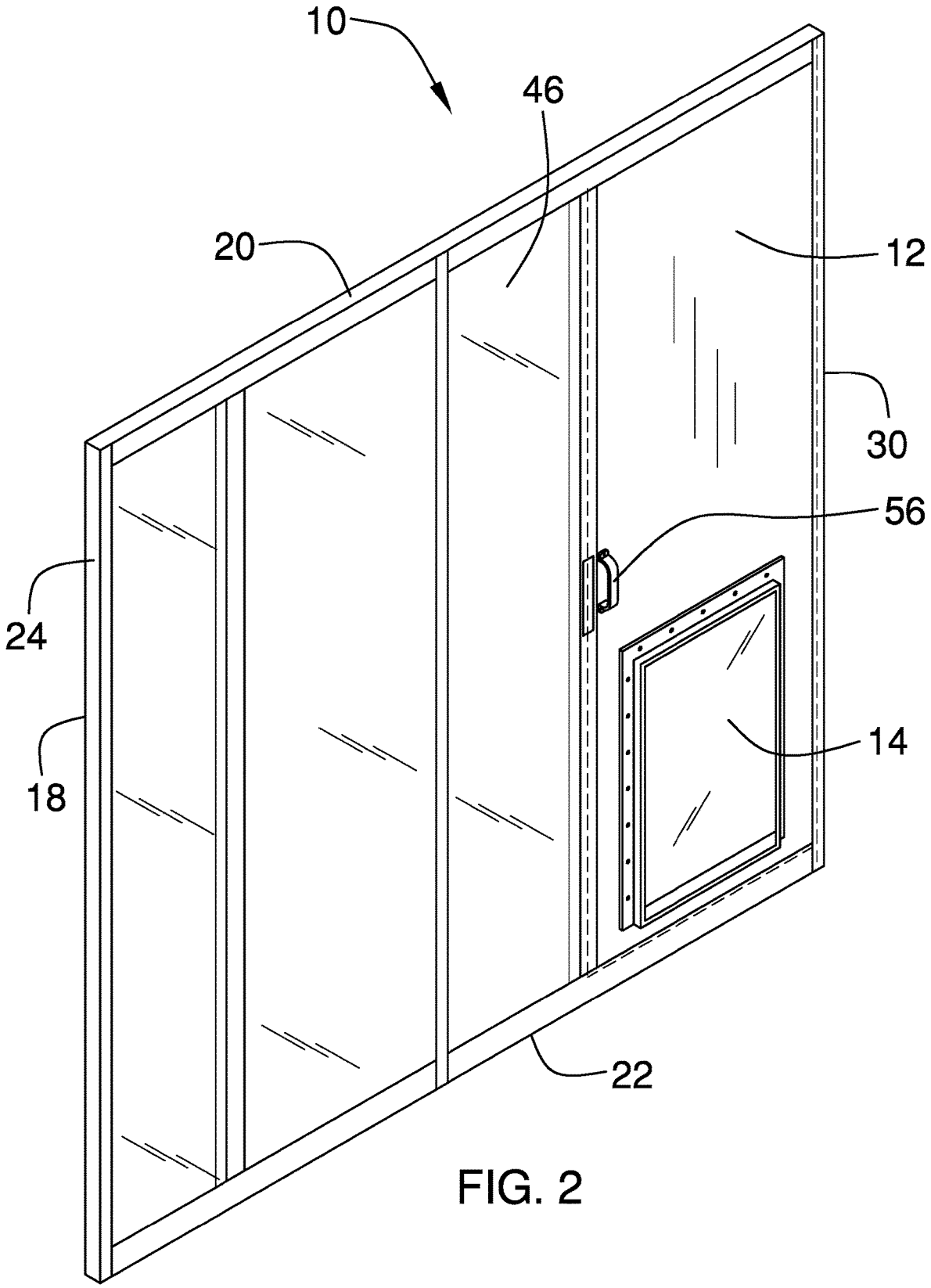
FIG. 2 is an in-use view of an embodiment of the disclosure.
Figure 3:
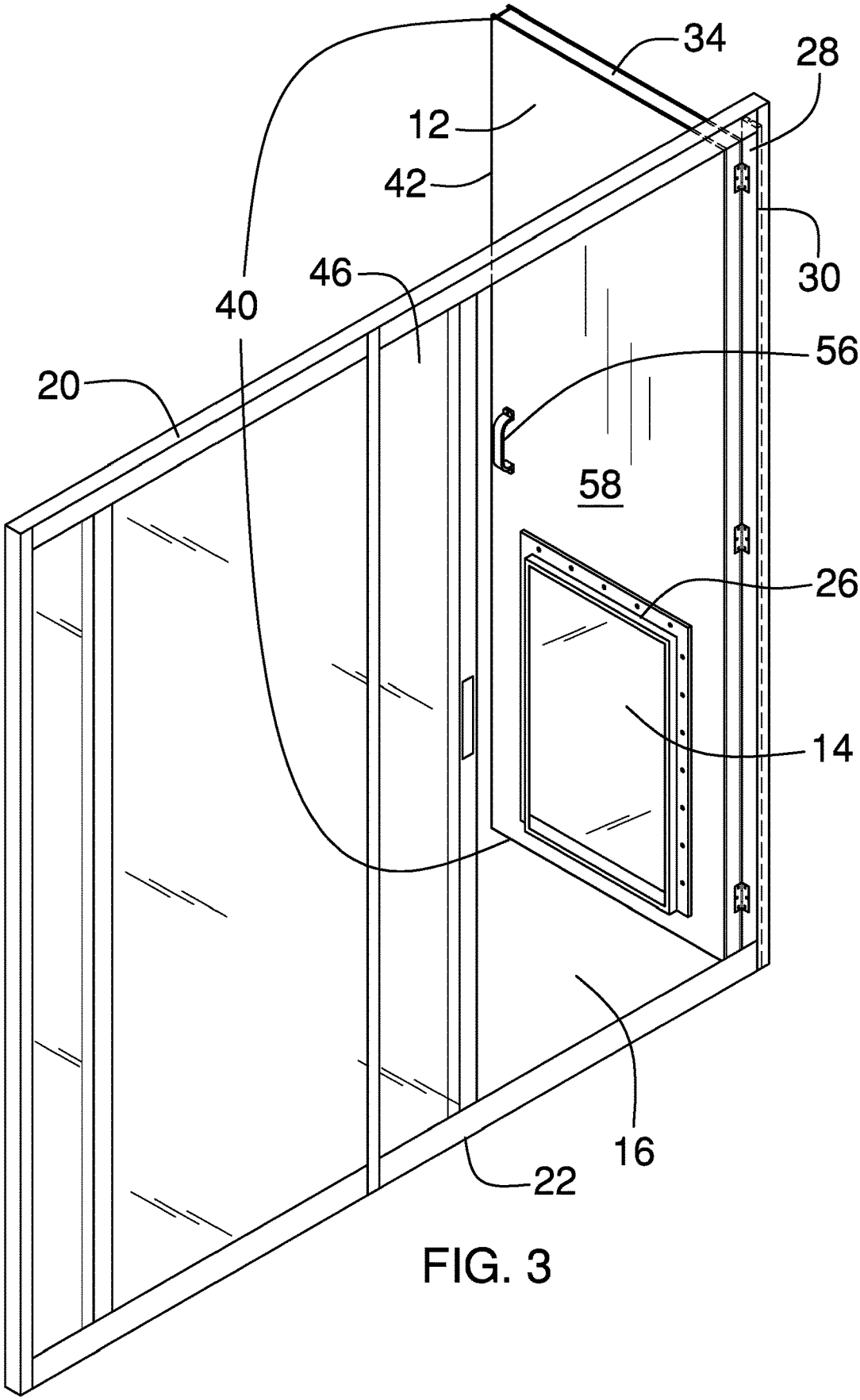
FIG. 3 is an in-use view of an embodiment of the disclosure.

A slat 28, which is shaped substantially complementarily to a side 30 of the frame 24, is hingedly coupled to a first side edge 32 of the panel 12. The slat 28 is dimensionally longer than the panel 12 so that the slat 28 extends past a top edge 34 and a bottom edge 36 of the panel 12, allowing the panel 12 to swing within the orifice 16, as shown in FIG. 3. The slat 28 is configured to insert into the frame 24, positioning the slat 28 adjacent to the side 30 and extending between the top 20 and the bottom 22 of the frame 24, as shown in FIG. 2. The slat 28 is frictionally coupled to the frame 24, positioning the panel 12 to selectively swing relative to the frame 24 to open and close the orifice 16 to allow a user to enter and exit the dwelling.

Each of a plurality of hinges 38 is coupled to and extends between the panel 12 and the slat 28 so that the panel 12 is hingedly coupled to the slat 28. The hinges 38 are positioned on the slat 28 and the panel 12 so that the panel 12 is configured to swing outwardly from the frame 24, as shown in FIG. 3. The plurality of hinges 38 comprises three hinges 38.

A pair of first strips 40 is coupled singly to the top edge 34 and the bottom edge 36 of the panel 12, as shown in FIG. 1. The first strips 40 comprise at least one of rubber, silicone, and plastic so that the first strips 40 are configured to seal the top edge 34 and the bottom edge 36 of the panel 12 to the top 20 and the bottom 22 of the frame 24, respectively, when the panel 12 is positioned in the orifice 16 of the sliding door module 18.

Figure 4:
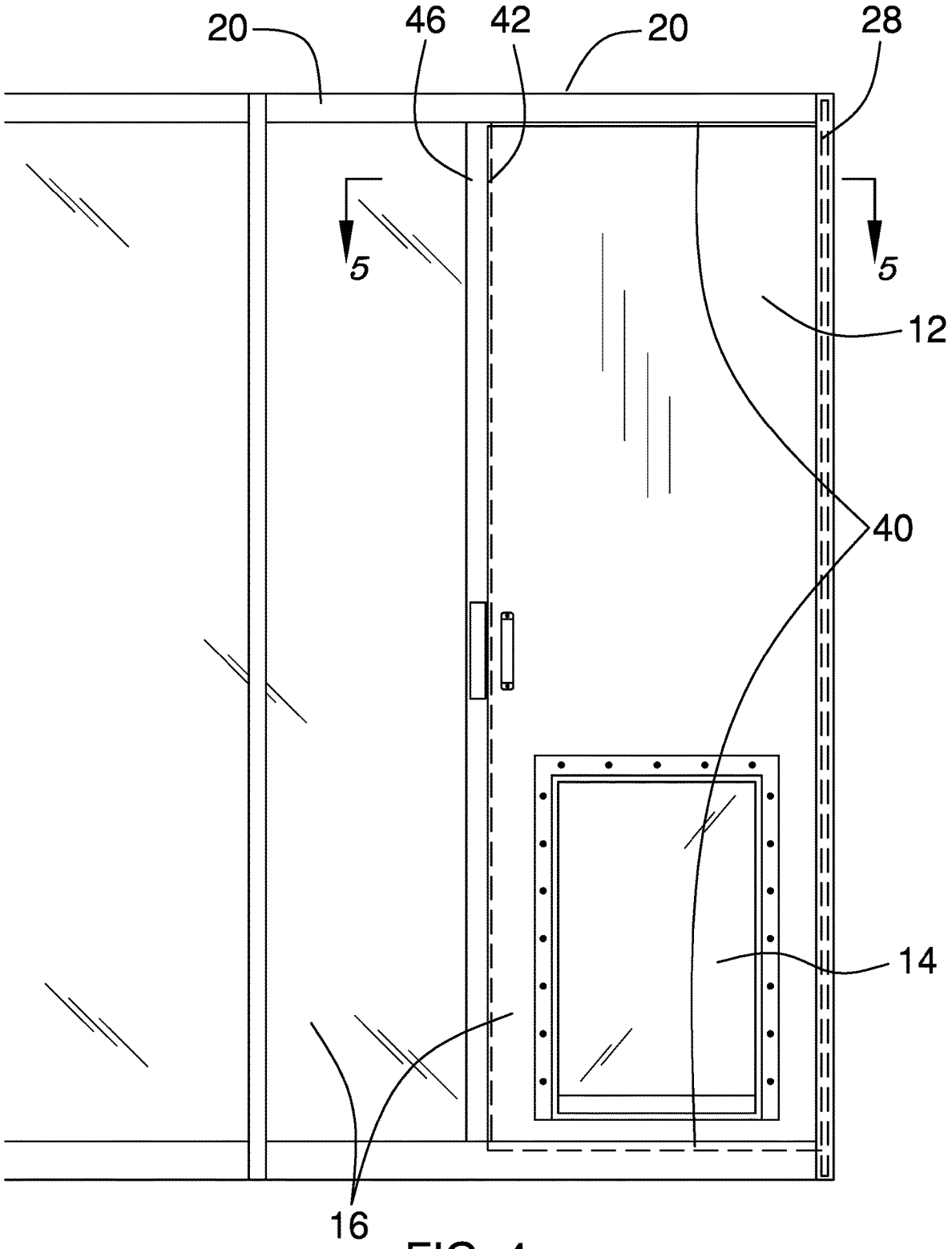
FIG. 4 is a front view of an embodiment of the disclosure.
Figure 5:
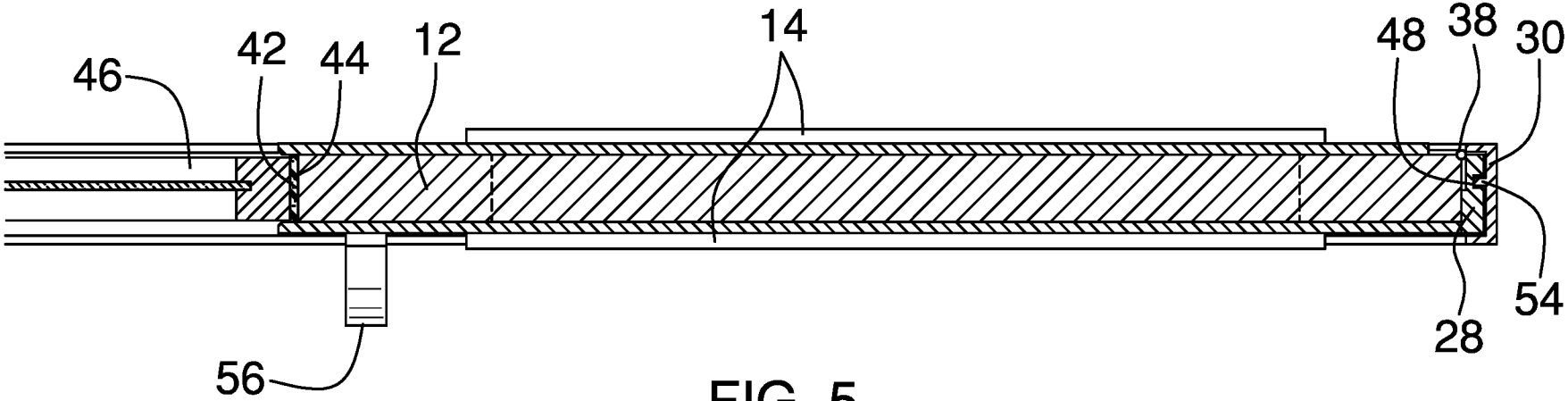
FIG. 5 is a cross-sectional view of an embodiment of the disclosure.

A second strip 42 is coupled to a second side edge 44 of the panel 12, as shown in FIG. 5. The second strip 42 comprises at least one of rubber, silicone, and plastic so that the second strip 42 is configured to seal the second side edge 44 of the panel 12 to a sliding door 46 of the sliding door module 18 when the panel 12 is positioned in the orifice 16 of the sliding door module 18 and the sliding door 46 is slid, within the frame 24, to abut the panel 12, as shown in FIG. 4.

A slot 48 that is positioned in the slat 28 extends from an upper end 50 to a lower end 52 of the slat 28. The slot 48 is configured to insert, as the slat 28 is inserted into the frame 24, an extrusion 54 that extends from the side 30 of the frame 24 so that the slat 28 is positioned adjacent to the side 30 of the frame 24, as shown in FIG. 5.

A handle 56 that is coupled to an inside face 58 of the panel 12 is configured to be grasped in a hand of the user to swing the panel 12 relative to the frame 24 of the sliding door module 18. The handle 56 is pull-handle type.

The pet door 14 is coupled to the panel 12 so that the pet door 14 is positioned to selectively close the aperture 26. The pet door 14 is configured to allow a pet to enter and exit the dwelling.

In use, the slat 28 is inserted into the frame 24 of the sliding door module 18 to position the panel 12 in the opening. The sliding door 46 then is slid within the frame 24 to abut the panel 12 so that the panel 12 is fixedly positioned within the orifice 16. The panel 12 and the sliding door 46 close the orifice 16. The pet can enter and exit the dwelling as needed through the pet door 14. When the user wants to enter or exit the dwelling, the sliding door 46 is slid within the frame 24 to an open position, and the panel 12 is swung relative to the frame 24 to open the orifice 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sliding door assembly having a sliding door module insert, the assembly comprising:

a panel sized such that the panel is configured for positioning in an orifice of a sliding door module positioned in an exterior wall of a dwelling with the panel extending from proximate to a top to proximate to a bottom of a frame of the sliding door module;

a slat hingedly coupled to a first side edge of the panel, the slat being shaped substantially complementarily to a side of the frame wherein the slat is configured for inserting into the frame positioning the slat adjacent to the side and extending between the top and the bottom of the frame such that the slat is frictionally coupled to the frame positioning the panel for selectively swinging relative to the frame for opening and closing the orifice for allowing a user to enter and exit the dwelling;

an aperture positioned in the panel; and a pet door coupled to the panel such that the pet door is positioned for selectively closing the aperture wherein the pet door is configured for a pet to enter and exit the dwelling.

2. The assembly of claim 1, further including the slat being dimensionally longer than the panel such that the slat extends past a top edge and a bottom edge of the panel wherein the panel is configured to swing within the orifice.

3. The assembly of claim 1, further including a plurality of hinges, each hinge being coupled to and extending between the panel and the slat such that the panel is hingedly coupled to the slat.

4. The assembly of claim 3, further including the hinges being positioned on the slat and the panel such that the panel is configured for swinging outwardly from the frame.

5. The assembly of claim 3, further including the plurality of hinges comprising three hinges.

6. The assembly of claim 1, further including a pair of first strips coupled singly to the top edge and the bottom edge of the panel, the first strips comprising at least one of rubber, silicone, and plastic such that the first strips are configured for sealing a top edge and a bottom edge of the panel to the top and the bottom of the frame, respectively, when the panel is positioned in the orifice of the sliding door module.

7. The assembly of claim 1, further including a second strip coupled to a second side edge of the panel, the second strip comprising at least one of rubber, silicone, and plastic such that the second strip is configured for sealing the second side edge of the panel to a sliding door of the sliding door module when the panel is positioned in the orifice of the sliding door module and the sliding door is slid within the frame to abut the panel.

8. The assembly of claim 1, further including a slot positioned in the slat, the slot extending from an upper end to a lower end of the slat wherein the slot is configured for inserting an extrusion extending from the side of the frame as the slat is inserted into the frame such that the slat is positioned adjacent to the side of the frame.

9. The assembly of claim 1, further including a handle coupled to an inside face of the panel wherein the handle is configured for grasping in a hand of the user for swinging the panel relative to the frame of the sliding door module.

10. The assembly of claim 9, further including the handle being pull-handle type.

11. The assembly of claim 1, further including the aperture being rectangularly shaped.

12. A sliding door assembly having a sliding door module insert, the assembly comprising:

a sliding door module positioned in an exterior wall of a dwelling;

a panel positioned in an orifice of the sliding door module with the panel extending from proximate to a top to proximate to a bottom of a frame of the sliding door module;

a slat hingedly coupled to a first side edge of the panel, the slat being shaped substantially complementarily to a side of the frame, the slat being inserted into the frame adjacent to the side and extending between the top and the bottom of the frame such that the slat is frictionally coupled to the frame wherein the panel is positioned for selectively swinging relative to the frame for opening and closing the orifice for allowing a user to enter and exit the dwelling;

an aperture positioned in the panel; and a pet door coupled to the panel such that the pet door is positioned for selectively closing the aperture wherein the pet door is configured for a pet to enter and exit the dwelling.

13. A sliding door assembly having a sliding door module insert, the assembly comprising:

a panel sized such that the panel is configured for positioning in an orifice of a sliding door module positioned in an exterior wall of a dwelling with the panel extending from proximate to a top to proximate to a bottom of a frame of the sliding door module;

a slat hingedly coupled to a first side edge of the panel, the slat being shaped substantially complementarily to a side of the frame wherein the slat is configured for inserting into the frame positioning the slat adjacent to the side and extending between the top and the bottom of the frame such that the slat is frictionally coupled to the frame positioning the panel for selectively swinging relative to the frame for opening and closing the orifice for allowing a user to enter and exit the dwelling, the slat being dimensionally longer than the panel such that the slat extends past a top edge and a bottom edge of the panel wherein the panel is configured to swing within the orifice;

a plurality of hinges, each hinge being coupled to and extending between the panel and the slat such that the panel is hingedly coupled to the slat, the hinges being positioned on the slat and the panel such that the panel is configured for swinging outwardly from the frame, the plurality of hinges comprising three hinges;

a pair of first strips coupled singly to the top edge and the bottom edge of the panel, the first strips comprising at least one of rubber, silicone, and plastic such that the first strips are configured for sealing the top edge and the bottom edge of the panel to the top and the bottom of the frame, respectively, when the panel is positioned in the orifice of the sliding door module;

a second strip coupled to a second side edge of the panel, the second strip comprising at least one of rubber, silicone, and plastic such that the second strip is configured for sealing the second side edge of the panel to a sliding door of the sliding door module when the panel is positioned in the orifice of the sliding door module and the sliding door is slid within the frame to abut the panel;

a slot positioned in the slat, the slot extending from an upper end to a lower end of the slat wherein the slot is configured for inserting an extrusion extending from the side of the frame as the slat is inserted into the frame such that the slat is positioned adjacent to the side of the frame;

a handle coupled to an inside face of the panel wherein the handle is configured for grasping in a hand of the user for swinging the panel relative to the frame of the sliding door module, the handle being pull-handle type;

an aperture positioned in the panel, the aperture being rectangularly shaped; and a pet door coupled to the panel such that the pet door is positioned for selectively closing the aperture wherein the pet door is configured for a pet to enter and exit the dwelling.

* * * * *